US007820903B2

(12) United States Patent
Susami

(10) Patent No.: US 7,820,903 B2
(45) Date of Patent: Oct. 26, 2010

(54) ELECTRONIC PERCUSSION INSTRUMENT

(75) Inventor: Ryo Susami, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 232 days.

(21) Appl. No.: 12/205,345

(22) Filed: Sep. 5, 2008

(65) Prior Publication Data

US 2009/0183627 A1 Jul. 23, 2009

(30) Foreign Application Priority Data

Sep. 7, 2007 (JP) ..... 2007-232222
Dec. 19, 2007 (JP) ..... 2007-326753

(51) Int. Cl.
*G10H 1/00* (2006.01)

(52) U.S. Cl. ..... 84/615; 84/653; 84/658; 84/687

(58) Field of Classification Search ..... 84/615, 84/653, 658, 687, 688–690
See application file for complete search history.

(56) References Cited

U.S. PATENT DOCUMENTS 5,262,585 A * 11/1993 Greene et al. ..... 84/645
5,770,812 A * 6/1998 Kitayama ..... 84/603
6,075,197 A * 6/2000 Chan ..... 84/730
6,815,604 B2 * 11/2004 Toda ..... 84/746
6,822,148 B2 * 11/2004 Yanase ..... 84/422.1
7,019,206 B2 * 3/2006 Mishima ..... 84/723
7,294,778 B2 * 11/2007 Susami ..... 84/723
7,435,888 B2 * 10/2008 Steele ..... 84/422.1
7,473,834 B2 * 1/2009 Yoshino ..... 84/402
7,560,638 B2 * 7/2009 Susami ..... 84/723
7,589,275 B2 * 9/2009 Arimoto ..... 84/723
7,642,440 B2 * 1/2010 Bailey ..... 84/411 R
2002/0112593 A1 * 8/2002 Yanase ..... 84/411 P
2003/0200860 A1 * 10/2003 Toda ..... 84/746
2003/0221545 A1 * 12/2003 Tomoda ..... 84/723
2005/0145101 A1 * 7/2005 Yoshino ..... 84/723
2005/0145102 A1 * 7/2005 Susami ..... 84/735
2005/0150349 A1 * 7/2005 Susami ..... 84/299
2006/0021495 A1 * 2/2006 Freitas ..... 84/723
2009/0139387 A1 * 6/2009 Toda ..... 84/422.3
2009/0183627 A1 * 7/2009 Susami ..... 84/735
2009/0241761 A1 * 10/2009 Hotta et al. ..... 84/737

FOREIGN PATENT DOCUMENTS

JP 2005-195981 7/2005

* cited by examiner

*Primary Examiner*—David S. Warren
(74) *Attorney, Agent, or Firm*—Foley & Lardner LLP

(57) ABSTRACT

An electronic percussion instrument can carry out the control of the musical tones that is intended by the performer. The instrument includes electronic controls that set a vibration flag when the instrument is struck and a determination is made as to whether or not a timer has timed a specified time period. If the timer has timed the specified time period, the vibration flag that is stored in the flag memory is reset. If the time period has not been reached, the displacement sensor processing ends and the routine returns to the main processing. In those cases where the vibration flag is not set, or in those cases where the resetting of the vibration flag has completed, a determination is made as to whether or not the upper cymbal has shifted from an open position to the closed position.

20 Claims, 8 Drawing Sheets

ELECTRONIC PERCUSSION INSTRUMENT

CROSS-REFERENCE TO RELATED PATENT APPLICATIONS

The present invention relates to Japanese Patent Application No. 2007-326753, filed on Dec. 19, 2007 and Japanese Patent Application No. 2007-232222, filed Sep. 7, 2007, each of which form a basis for a priority filing date for the present invention and each of which is incorporated herein by reference in its entirety.

FIELD OF THE INVENTION

The present invention relates to electronic percussion instruments and, in particular, to electronic percussion instruments with which it is possible to carry out the control of the musical tone that the performer intends to produce.

BACKGROUND OF THE INVENTION

For some time, electronic percussion instruments that mimic an acoustic hi-hat cymbal have been produced where the hi-hat timbre is controlled by the amount that the foot pedal is depressed (from being stepped on by a performer). In other words, the hi-hat timbre is controlled in conformance with the amount of change in the position of the upper cymbal based on the amount to which the foot pedal is depressed from being stepped on. In Japanese Unexamined Patent Application (Kokai) Publication Number 2005-195981, an electronic hi-hat cymbal is disclosed in which the upper cymbal moves up and down in conformance with the amount that the foot pedal is depressed to simulate a performance feeling of an acoustic hi-hat cymbal.

FIGS. 6(*a*) and 6(*b*) show an electronic hi-hat 80 similar to that disclosed in Japanese Unexamined Patent Application (Kokai) Publication Number 2005-195981. FIG. 6(*a*) is a lateral cross-section drawing of the entire electronic hi-hat unit, but with a lateral view (without cross-section) of the upper cymbal 100 and the lower cymbal 200. A cross-section view of the upper cymbal 100, lower cymbal 200 and the portion between the upper and lower cymbals is shown in the drawing of FIG. 6(*b*).

As is shown in FIG. 6(*a*), the electronic hi-hat 80 is furnished with the upper cymbal 100, the lower cymbal 200, an extension rod 420 to which the upper cymbal is linked in a manner that allows vibration of the upper cymbal 100, and a hollow shaft member 410 to which the lower cymbal is linked in a manner that allows vibration of the lower cymbal 200. A spring 430 is placed in the inner lower end of the hollow shaft member 410. The electronic hi-hat 80 also includes a treading foot pedal 440, a joint 450 that links the extension rod 420 and the foot pedal 440, and a leg section 460 linked to the hollow shaft member 410, for supporting the electronic hi-hat 80 in a standing orientation.

The extension rod 420 is linked on the lower portion to the foot pedal 440 through the joint 450 in a configuration such that the extension rod 420 moves up and down in conformance with the treading operation of the foot pedal 440. The upper cymbal 100 is linked by a linking fitting to the upper portion of the extension rod 420 in a manner such that the upper cymbal is able to vibrate and move up and down together with the up and down movement of the extension rod 420, in conformance with the treading operation of the foot pedal 440.

The lower portion of the extension rod 420 passes through the upper hollow shaft 411 and the lower hollow shaft 412, and also passes through the spring 430 inside the lower hollow shaft 412. The spring 430 is held sandwiched between the bottom of a knurl section 420*a* on the extension rod 420 and the top of a knurl section 412*a* of the lower hollow shaft 412, such that the extension rod 420 is always subjected to a force biasing the rod 420 upward. As a result, when the treading operation of the foot pedal 440 is not being carried out, the upper cymbal 100 and the lower cymbal 200 are separated at a specified interval.

Next, an explanation will be given regarding the upper cymbal 100 and the lower cymbal 200 while referring to FIG. 6(*b*). FIG. 6(*b*) shows the upper cymbal 100 and the lower cymbal 200 in the open position or separated state. When the foot pedal 440 is stepped on by a sufficient amount, the upper cymbal 100 and the lower cymbal 200 will be in a closed position in which the upper cymbal 100 and the lower cymbal 200 are in a state of close contact.

The upper cymbal 100 has a striking surface 110 that is formed using rubber on the top surface. On the side of the upper cymbal 100 facing opposite to the side of the striking surface 110, a vibration sensor 70 is disposed on a vibration sensor attaching frame 120. The vibration sensor 70 is a sensor that detects the vibration level of the vibrations of the upper cymbal 100 due to the striking of the upper cymbal 100 or the contact between the upper cymbal 100 and the lower cymbal 200 and is, for example, a piezoelectric sensor. When the vibration sensor detects the vibration level, an analog electrical signal that corresponds to the vibration level is transmitted to a stereo jack 150 linked for output by a connecting cable (not shown in the drawing). The analog electrical signal is input via the plug 130, the cable 131, and the stereo jack 230, to the stereo jack 250 of the lower cymbal 200. The stereo jack 250 is linked for input from the stereo jack 150 and output from an output terminal (not shown in the drawing).

As shown in FIG. 6(*b*), the displacement sensor 60 is arranged between the upper cymbal 100 and the lower cymbal 200. The displacement sensor 60 is configured with a circular sensor sheet that is housed in the bottom of the inside of a hollow cylinder, the top of which is open. The displacement sensor 60 is further configured with a conical shaped coil spring that is arranged on the sensor sheet and that widens from the top downward, and a cover that is in contact with the top of the coil spring. When the foot pedal 440 is stepped on, the gap between the upper cymbal 100 and the lower cymbal 200 closes by an amount in conformance with the amount that the foot pedal has been depressed.

As the foot pedal descends by being stepped on, the cover section is pressed downward and the coil spring is pressed against the cushion sheet and is compressed and changes shape in the vertical direction due to the compression force. The sheet section is used for electrical detection of the changes in shape by the coil spring caused by the compression in the vertical direction. In that manner, the amount that the foot pedal 440 is depressed and, thus, the change in the position of the upper cymbal 100 (hereafter, referred to as the "upper cymbal position") is detected. When the conical shaped coil spring compresses and changes shape due to the foot pedal 440 being depressed, the coil spring presses against a resistor-printed sheet material of the sensor sheet section, to press a portion of the resistor-printed sheet material against a carbon-printed circuit board. As a result, conductive ink of the resistor-printed sheet material comes into contact with an electrode pattern of the carbon-printed circuit board and the electrical resistance value of the carbon printed circuit board changes. This electrical resistance value changes in conformance with the amount of the pressure deformation of the coil spring and, thus, in conformance with the upper cymbal position due to the amount that the foot pedal 440 is depressed. The electrical resistance value is detected via an output terminal (not shown in the drawing).

In this manner, an electronic hi-hat cymbal configuration has been made such that the upper cymbal is moveable relative to the lower cymbal and the position of the upper cymbal 100 (the upper cymbal position) is detected by the displacement sensor 60. In addition, if that the upper cymbal 100 is vibrated due to the striking of the upper cymbal or due to the foot pedal being stepped on by a sufficient amount to cause the upper cymbal to come into contact with the lower cymbal 200, a musical tone is produced that conforms to the upper cymbal position that has been detected by the displacement sensor 60. At that time, the vibration sensor 70 detects the vibration level of the upper cymbal 100 and, if the vibration level exceeds a specified threshold value, a trigger signal is output to the sound source that instructs the audible generation of the musical tone.

FIG. 7 is a drawing that shows, visually, the relationship between the upper cymbal position that has been detected by the displacement sensor 60 and the timbre of the musical tone that is generated by the sound source. The horizontal axis shows the displacement sensor values and the vertical axis shows the levels of the musical tones that are generated. The displacement sensor values that are shown on the horizontal axis correspond to the relative positions of the upper cymbal 100 and the lower cymbal 200, where the left end of the horizontal axis corresponds to the cymbals being in close contact, with the values going toward the right correspond to increasing separations between the upper cymbal 100 and the lower cymbal 200. The range in which the displacement sensor values are smaller than a specified threshold value is called the closed position, while the range in which they are greater than a specified threshold value is called the open position.

There are five types of hi-hat sounds (open sound, half sound, slightly open sound, closed sound, and press sound) that are assigned correspondingly to the output ranges for the displacement sensor values. The open sound, half sound, and slightly open sound, which correspond to the open position, are classified as the musical tones of the open group. The closed sound and press sound, which correspond to the closed position, are classified as the musical tones of the closed group. The cross-fading of the each of the musical tones is done with the musical tones of the open group (the open sound, half sound, and slightly open sound) in conformance with the displacement sensor values. Similarly, cross-fading is done with the musical tones of the closed group (the closed sound and the press sound) in conformance with the displacement sensor values.

In addition, the musical tones of the open group and the musical tones of the closed group, as is the case with an acoustic hi-hat cymbal, are switched mutually exclusively at a specified threshold value of the displacement sensor values.

The sound source is controlled such that when the foot pedal is stepped on and the displacement sensor value becomes a specified threshold value or lower at the time that the upper cymbal position is at the open position and a musical tone of the open group is generated, an instruction is issued for the generation of a musical tone of the closed group and the musical tone of the open group that is currently being produced rapidly attenuates (truncates) and, together with this, a musical tone of the closed group is generated.

However, with an electronic hi-hat such as that described above, when the foot pedal has not been depressed, but the upper cymbal is struck with a stick or the like with a force strong enough to cause the upper cymbal to drop such that the position of the upper cymbal reaches the threshold value, the cymbal sound is extinguished even though this was not the intention of the performer.

FIGS. 8(*a*)-(*c*) show timing charts in which that event is represented, where the time is shown on the horizontal axis and the displacement sensor value is shown on the vertical axis. The condition of the musical tone that is generated by the sound in the case where the displacement sensor value has changed in the above-noted manner is shown in FIGS. 8(*b*) and (*c*).

FIG. 8(*b*) shows the time on the horizontal axis and the level of a musical tone of the open group that is generated by the sound source on the vertical axis. Similarly, FIG. 8(*c*) shows the time on the horizontal axis and the level of the musical tone of the closed group that is generated by the sound source on the vertical axis.

FIG. 8(*a*) shows the case in which, when the displacement sensor is at an open position that is in the vicinity of the threshold value (indicated by the alternating long and short dashed line), the upper cymbal 100 has been struck at time a. As shown in FIG. 8(*a*), the displacement sensor value starts to drop from time a, goes below the specified threshold value at time b, and becomes one of a closed position.

Since the upper cymbal 100 has been struck at time a, as is shown in FIG. 8(*b*), the generation of a musical tone of the open group begins. Next, since at time b, the upper cymbal 100 changes from the open position to the closed position, the musical tone of the open group that is being generated rapidly attenuates. At the same time, as is shown in FIG. 8(*c*), a waveform of the closed group is generated. After that, at time c, the musical tone of the open group is again generated with the return of the displacement sensor value to the original value and the musical tone of the closed group attenuates. Accordingly, in the interval from time b to c, a rapid attenuation is carried out of the musical tone of the open group and the generation of a musical tone of closed group occurs that was not intended by the performer.

However, such unintended effects can be avoided with embodiments of the present invention in which an electronic percussion instrument may be controlled to provide a musical tone that is intended by the performer.

SUMMARY OF THE DISCLOSURE

An electronic percussion instrument according to an embodiment of the present invention is furnished with position detection means that detects the position of the striking surface that is set to any arbitrary position. Striking detection means is provided that detects whether the striking surface has been struck. If the striking detection means detects that the striking surface has been struck, then musical tone generation instruction means instructs the sound source to generate a musical tone in conformance with the position of the striking surface that has been detected by the position detection means. If the position that has been detected by the position detection means is the first position, then musical tone stopping means instructs the sound source to discontinue the musical tone that has been generated in conformance with the instruction by the musical tone generation instruction means. However, a first timing means times the time from the point at which a strike of the striking surface has been detected by the striking detection means. Control means is provided that suppresses the stopping instruction for the musical tone by the musical tone stopping instruction means in the interval up to the lapse of a specified time period in the time that is timed by the first timing means.

Thus, in those cases where the striking detection means detects that the striking surface has been struck, an instruction is issued by the musical tone generation instruction means for the generation of a musical tone in conformance with the position of the striking surface that has been detected by the position detection means. For example, if the upper cymbal has been struck, an open sound is generated if the position of the upper cymbal is up, or a closed sound is generated if the position of the upper cymbal is down. The musical tone stopping instruction means issues an instruction to the sound source to stop the musical tone that has been generated by the musical tone generation instruction means, if the position that has been detected by the position detection means is the first position. For example, if an open sound is being generated, the open sound is stopped when the upper cymbal is operated downward.

In addition, the first timing means times the time period from the time that the striking detection means detects that the striking surface has been struck, and the control means suppresses the instruction for the stopping of the musical tone by the musical tone stopping instruction means until a specified time period has lapsed for the time period timed by the first timing means. Therefore, even in those cases where the position of the upper cymbal shifts downward because of the fact that the upper cymbal has been struck, the control is carried out such that the musical tone that is generated by the striking is not stopped during a specified time period. In the past, if the upper cymbal had been struck, there were times when the upper cymbal was shifted downward for a comparatively short period of time and, unintentionally to the performer, the musical tone generation stopped. In contrast, according to the above embodiment of the present invention, the unintended stopping of the musical tone is suppressed, providing an advantageous result that it is possible to carry out the control of the musical tone that is more closely intended by the performer.

In further embodiments of the above electronic percussion instrument, after the lapse of the specified time period for the time that is timed by the first timing means, the control means carries out the control such that, if the position that has been detected by position detection means is the first position, an instruction is issued by the musical tone stopping instruction means to stop the musical tone. Thus, in addition to the advantageous results described above, if an operation has been carried out intentionally by the performer that causes the upper cymbal to drop, it is possible to stop the musical tone that is being generated. Therefore, there is a further advantageous result that the performer can carry out the control of the musical tone that is closer to the performer's intention.

In yet further embodiments of an electronic percussion instrument as described above, the musical tone generation instruction means issues an instruction to the sound source such that, in the event that the position detection means has detected that the position on the striking surface is the second position, a musical tone having a specified timbre is generated. The first timing means carries out timing in the event that the position of the striking surface that has been detected by the position detection means is the second position when the striking detection means detects that the striking surface has been struck. Thus, when, for example, the upper cymbal is struck while positioned upward, an open sound is generated and in that case, the timing is carried out and until a specified period of time has lapsed for the time period that has been timed, the stopping of the open sound is suppressed. Therefore, such embodiments may provide a further advantageous result that it is possible to control the musical tone to be closer to that intended by the performer.

In yet further embodiments of an electronic percussion instrument as described above, the instrument is furnished with vibration level detection means that detects the level of the vibration of the striking surface. The striking detection means detects the fact that the striking surface has been struck in the event that the level of the vibration that has been detected by the vibration level detection means is greater than the first threshold value. The first timing means carries out timing in the event that the level of the vibration that has been detected by the vibration level detection means is greater than the second threshold value, which is greater than the first threshold value.

Therefore, if the striking force is small, a musical tone is generated and the suppression of the stopping of the musical tone is not carried out. However, if the striking force is great, the stopping of the musical tone is suppressed during generation of the musical tone. If the vibration level is small, the striking force strength is small. Previously, if the upper cymbal was not moved but the vibration level was great, there were cases where the upper cymbal was shifted sufficiently to cause the musical tone to be stopped. In contrast, in the above-described embodiment of the present invention, if the striking force strength is sufficiently large, the stopping of the musical tone is suppressed. Accordingly, such embodiments can provide the further advantageous result of controlling the musical tone to be closer to that intended by the performer.

In yet further embodiments of an electronic percussion instrument as described above, the instrument is furnished with second timing means that starts timing when, in the interval until the specified time period has lapsed for the time period that is timed by the first timing means, the position on the striking surface that has been detected by the position detection means is the first position. When a specified time has lapsed for the time period that is timed by the second timing means, the control means suppresses the instruction for the stopping of the musical tone by the musical tone stopping instruction means in the event that the position of the striking surface that has been detected by the position detection means is not the first position. In addition, the electronic percussion instrument is provided with controls such that the instruction for the stopping of the musical tone by the musical tone stopping instruction means is carried out in the event that the position of the striking surface that has been detected by the position detection means is the first position. Therefore, such embodiments can provide a further advantageous result that, if the performer has struck the striking surface, the stopping of the musical tone due to the fact that the striking surface has dropped can be suppressed and, together with this, it is possible to immediately stop the musical tone in those cases where the position of the striking surface has been shifted to the first position intentionally by the performer.

In yet further embodiments of an electronic percussion instrument as described above, the instrument is furnished with filter means that changes the fluctuations in position that have been detected by the position detection means to dampened fluctuations. In the event that, during the interval until the specified time period has lapsed for the time period that is timed by the first timing means, the position that has been changed by the previously mentioned filter means is the first position, the control means instructs the sound source to stop the musical tone that has been generated in conformance with the instruction by the musical tone generation instruction means. In the event that, after the lapse of the specified time period for the time period that is timed by the first timing means, the position that has been detected by the position detection means is the first position, the control means controls such that the instruction for the stopping of the musical tone by the musical tone stopping instruction means is carried out.

Thus, even in those cases where the striking surface has dropped because of the striking surface had been struck, it is possible to change the distance shifted due to the dropping to a small distance and to suppress the stopping of the musical tone that has been started by the striking of the striking surface. On the other hand, since after the lapse of the specified time period, the determination as to whether or not the position is the first position is made by the position of the striking surface that has been detected by the position detection means rather than the position that has been changed by the change means, there is the advantageous result that if, for example, the upper cymbal has dropped because of the operation of the foot pedal by the performer, the musical tone that has been started by the striking of the upper cymbal is stopped and the control of the musical tone that is intended by the performer is possible.

DETAILED DESCRIPTION OF THE PREFERRED EMBODIMENTS

Figure 1:
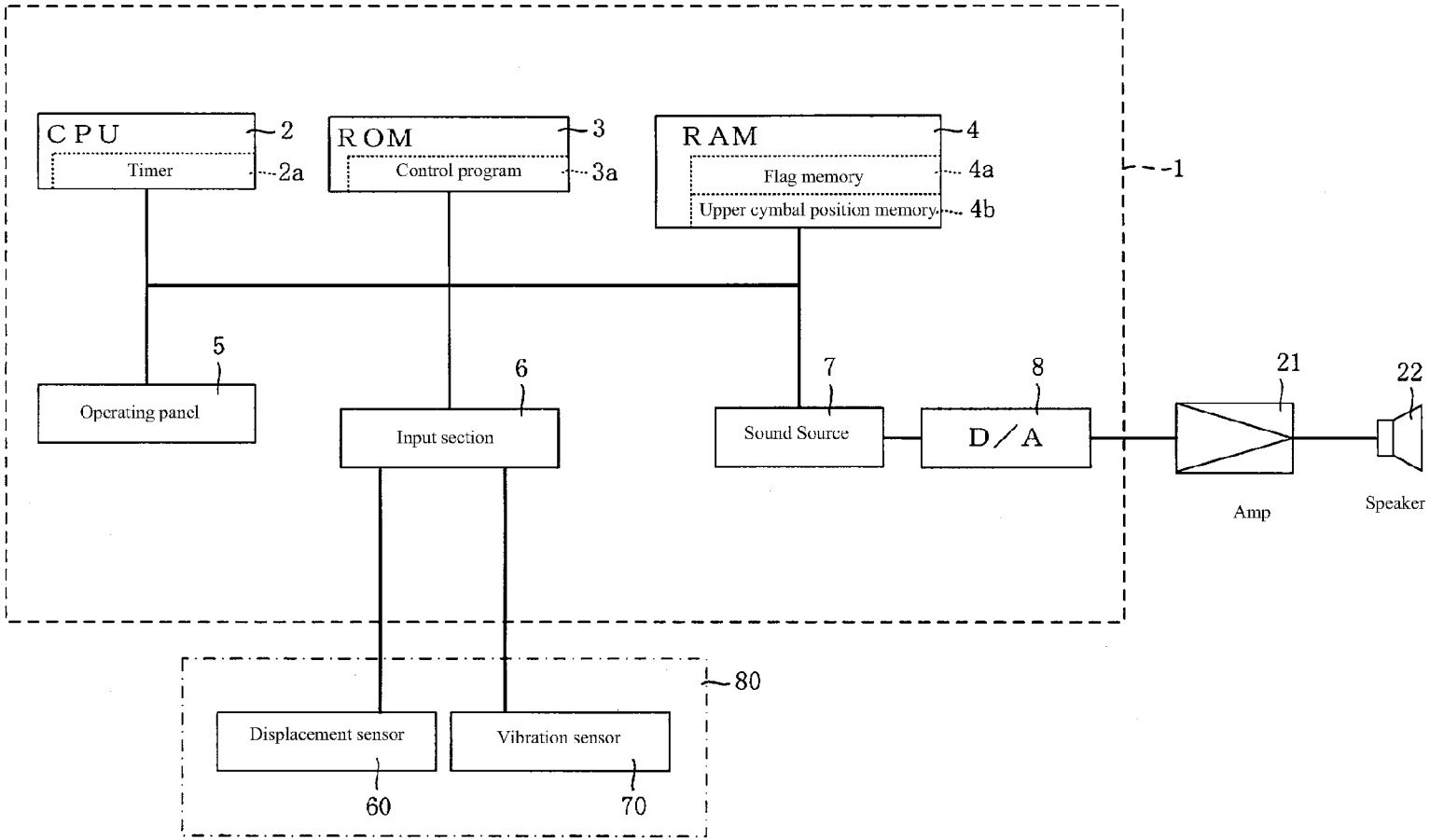
FIG. 1 is a block diagram that shows an example electronic system configuration of an electronic percussion instrument according to an embodiment of the present invention.

An explanation will be given below regarding a first embodiment of the present invention while referring to the attached drawings. FIG. 1 is a block diagram that shows an electrical configuration of an electronic percussion instrument 1, according to an embodiment of the present invention. The musical tones of the electronic percussion instrument 1 can be controlled in accordance with the intentions of the performer, as described herein. As is shown in FIG. 1, the electronic percussion instrument 1 includes, in general, a CPU 2, a ROM 3, a RAM 4, an operating panel 5, an input section 6, a sound source 7, and a D/A converter 8.

Figure 2:
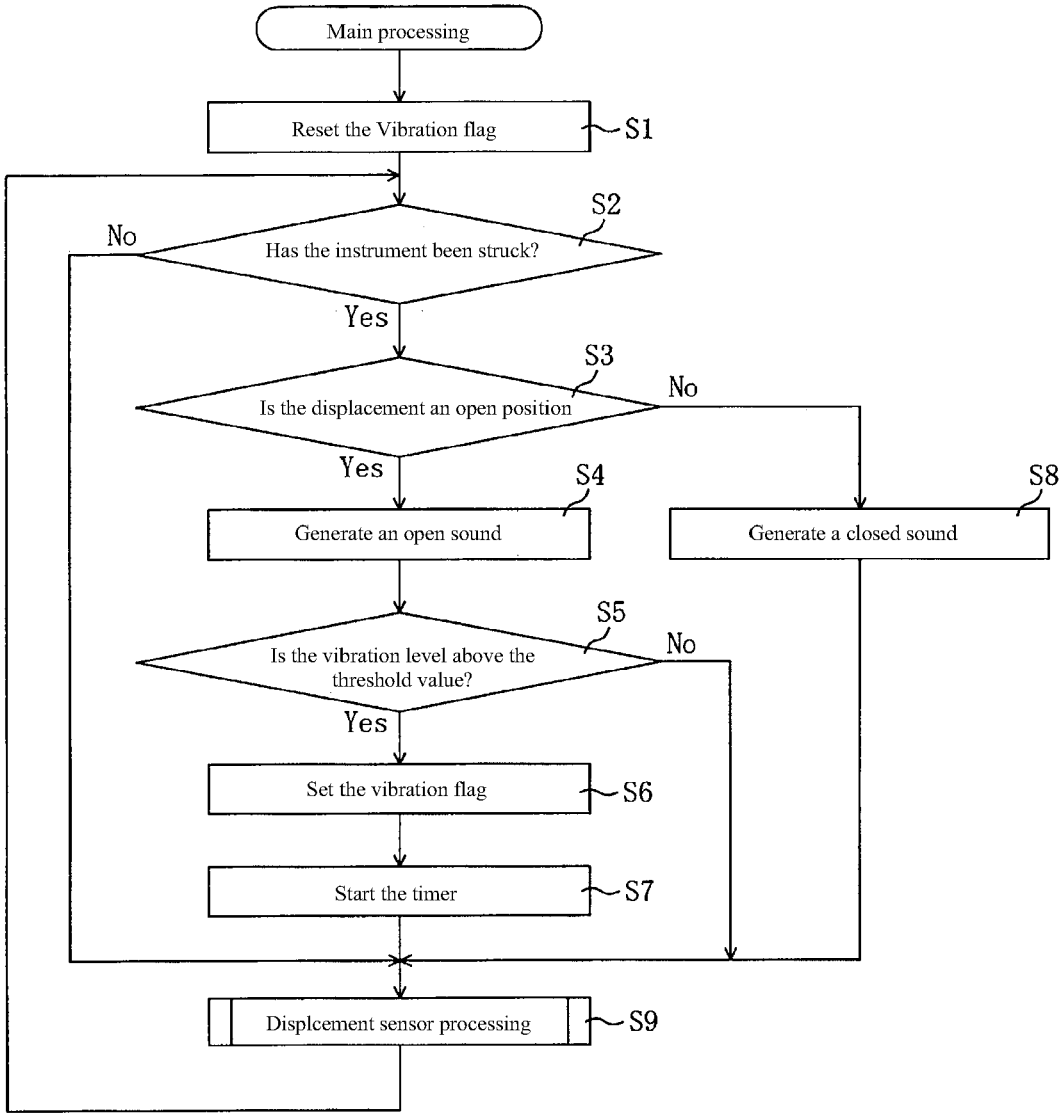
FIG. 2 is a flowchart that shows an example of main processing that is executed by a CPU, such as the CPU of FIG. 1.
Figure 3:
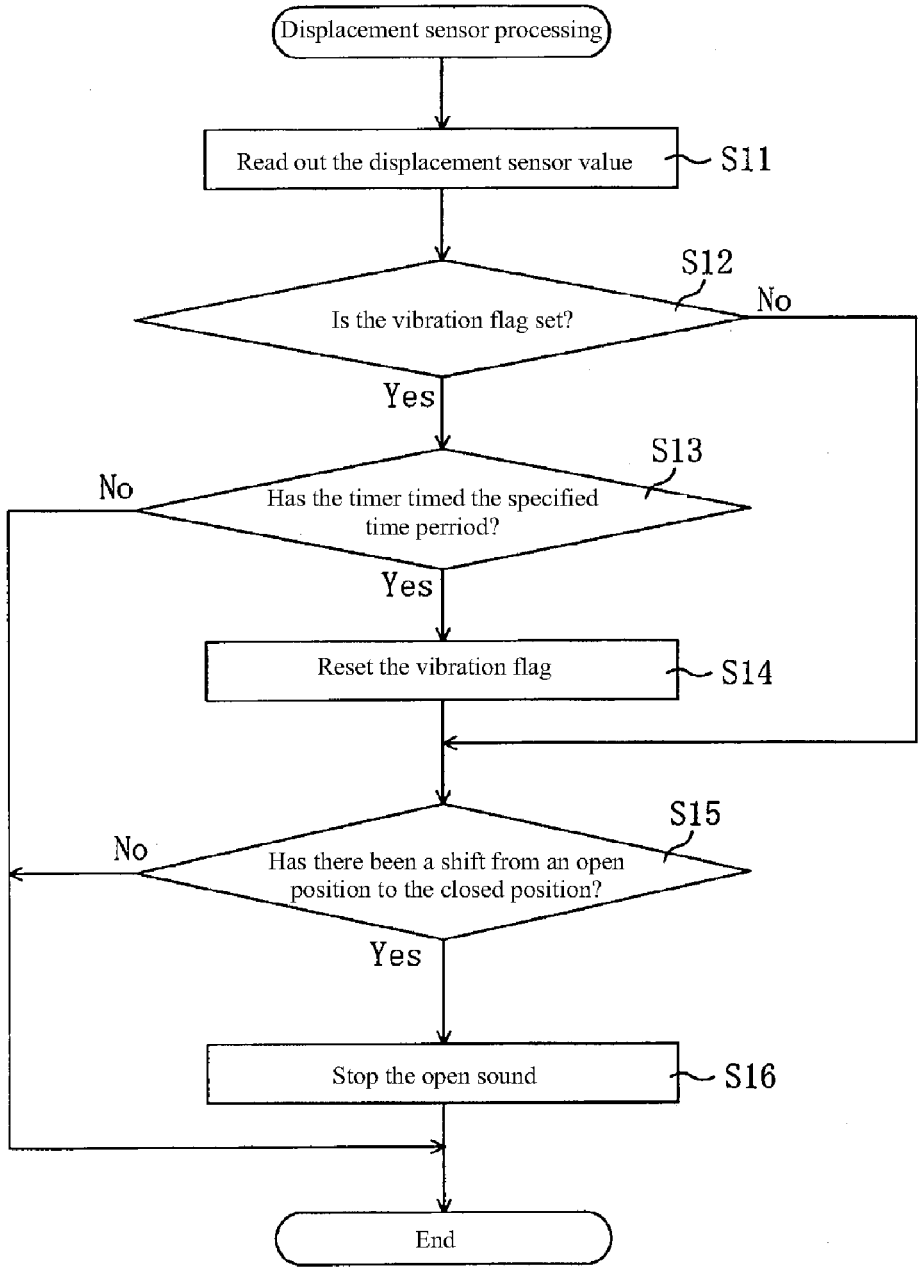
FIG. 3 is a flowchart that shows an example of displacement sensor processing according to a first embodiment of the present invention.

The CPU 2 is a central processing unit or any suitable processing electronics that carries out the overall control of the electronic percussion instrument 1. A timer 2*a*, which times the time periods described herein, may be built into the CPU 2 or otherwise connected in communication with the CPU 2. Various control programs 3*a* that are executed by the CPU 2 and the fixed data that is referred to at the time of the execution are stored in the ROM 3. Such control programs 3*a* may include, but are not limited to, programs that execute the processing of the flowcharts that are shown in FIG. 2 and FIG. 3 and discussed below.

The RAM 4 is a random access rewritable memory that has the working area in which various types of register groups and the like that are used at the time that the control programs 3*a* are executed by the CPU 2, as well as the temporary storage area that temporarily stores the data during processing, and the like. A flag memory 4*a* and an upper cymbal position memory 4*b* may be located in the temporary storage area. A striking flag is stored in the flag memory 4*a*. The striking flag is set in those cases where the upper cymbal 100 has been struck and is reset after a specified period of time has been timed by the timer 2*a*. During this specified period of time, even in those cases where the position of the upper cymbal has shifted from open to closed, the control is carried out such that the musical tone that is generated in conformance with the fact that the upper cymbal has been struck is not stopped.

The position of the upper cymbal 100 that has been detected by the displacement sensor 60 (hereafter, referred to as the "upper cymbal position") is stored in the upper cymbal position memory 4*b*. An upper cymbal position is detected for each one of a plurality of specified time periods, for example, periodically or at other specified intervals of time. Position data for the position that had been detected the previous time is stored in the upper cymbal position memory 4*b*. Each time that the position of the upper cymbal is detected, a determination is made as to whether or not the upper cymbal position has shifted from an open position to a closed position, for example, by a comparison of position data associated with the present detected position with the position data for the position that had been detected the previous time.

The sound source 7 generates musical tones or stops the musical tone that is being generated in accordance with the instructions of the CPU 2. A waveform ROM (not shown) may be disposed in the sound source 7 or otherwise connected for communication with the sound source 7 for storing waveform data. The stored waveform data may include waveform data for a the hi-hat sounds (open sound, half sound, closed sound, and the like) that correspond to the upper cymbal positions indicated by the displacement sensor values detected by the displacement sensor 60. In those cases where the vibration level that has been detected by the vibration sensor 70 exceeds a threshold value, a determination may be made that the striking surface has been struck and a digital musical tone having a timbre that corresponds to the displacement sensor value that has been detected by the displacement sensor 60 at that time is read out from the waveform ROM. A digital musical tone signal corresponding to the waveform data read out from the ROM is output and may be subjected to specified processing such as filter, effect, and the like.

The sound source 7 may include or otherwise operate with a DSP (digital signal processor) that carries out processing such as filter, effect, and the like. The DSP may form or provide a function of a TVF (time variant filter). In one example, the TVF is a lowpass filter with which the cut-off frequency can be changed and in those cases where, for example, an open sound is generated by the sound source 7, the cut-off frequency is set to a high value and in those cases where a closed sound is generated, the cut-off frequency is set to a low value relative to the high value.

The digital musical tone signal that has been output by the sound source 7 is provided to the D/A converter 8. The D/A converter 8 converts the digital musical tone signal into an analog musical tone signal that is output to the amp 21. The amp 21 amplifies the analog musical tone signal and drives the speaker 22.

The operating panel 5 may be furnished with one or more operators that set parameters such as the volume and the like and one or more display devices that display the values of the parameters that have been set by the operators and the like. Threshold values for the sensors and the like also may be set as desired, using the operating panel 5.

Figure 6:
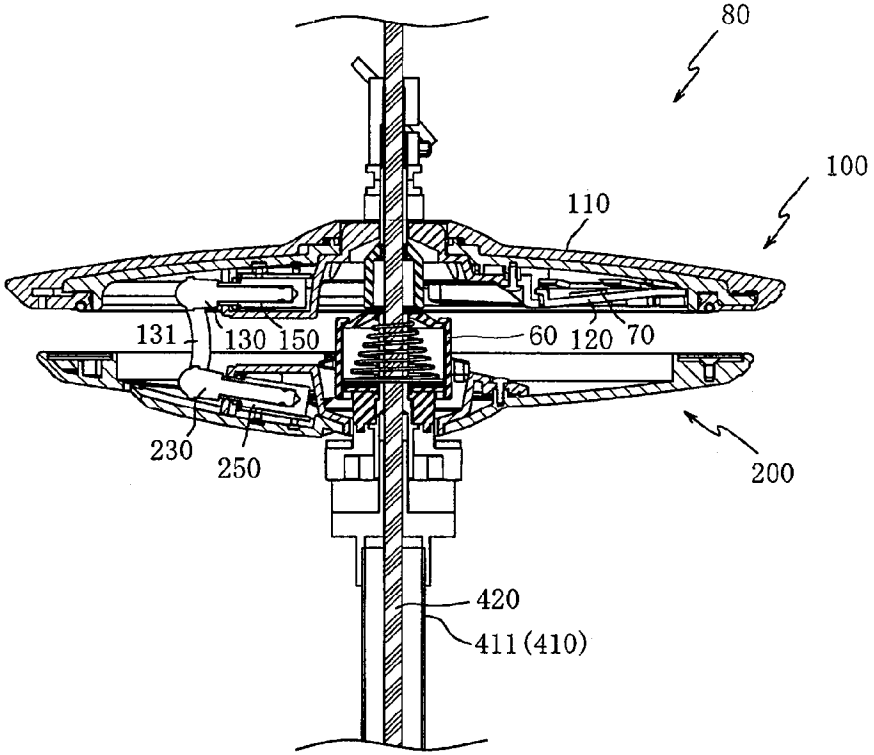
FIGS. 6(*a*) and 6(*b*) show a prior configuration of an electronic hi-hat, where FIG. 6(*a*) is a partial cut-away, lateral view drawing of the electronic hi-hat, and FIG. 6(*b*) is a lateral cross section drawing of the upper cymbal and the lower cymbal of the electronic hi-hat.
Figure 6:
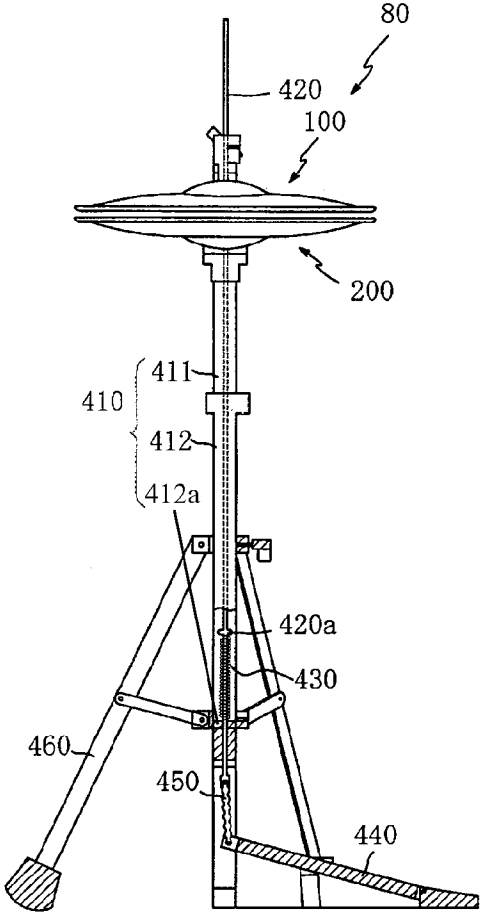

The input section 6 may include one or more input terminals with which the respective analog signals are input from a displacement sensor and a vibration sensor, such as the displacement sensor 60 and the vibration sensor 70 on the electronic hi-hat in FIG. 6. The displacement sensor value (the position data) that is detected by the displacement sensor 60 and the vibration level that is detected by the vibration sensor 70 are each input to the input terminal(s) of the input section 6. In one example, the sensors 60 and 70 detect analog sensor values that are input to an A/D converter (not shown), converted into a digital value in the A/D converter and output to the CPU 2 each specified time period.

The flow charts in FIGS. 2 and 3 relate to an example of processing in an electronic percussion instrument 1 that has been configured as described above for the appropriate control of the musical tone. FIG. 2 is a flowchart that shows an example of a process carried out by main processing software that may be executed by the electronic percussion instrument 1. This main processing software may be launched when the power is turned on and may be executed repeatedly by the CPU 2 during the time that the power remains on.

According to the main processing process, the striking flag that is stored in the flag memory 4*a* is reset (S1). Next, the vibration level that has been detected by the vibration sensor 70 is input and a determination is made as to whether or not the upper cymbal 100 has been struck (S2). For example, if the detected vibration level is greater than the a first threshold value, the determination is that the cymbal has been struck, and if the detected vibration level is smaller than the first threshold value, the determination is that the cymbal has not been struck. The process can include determining that the cymbal has been struck (or, alternatively, has not been struck), if the detected vibration level happens to equal the first threshold value.

Figure 7:
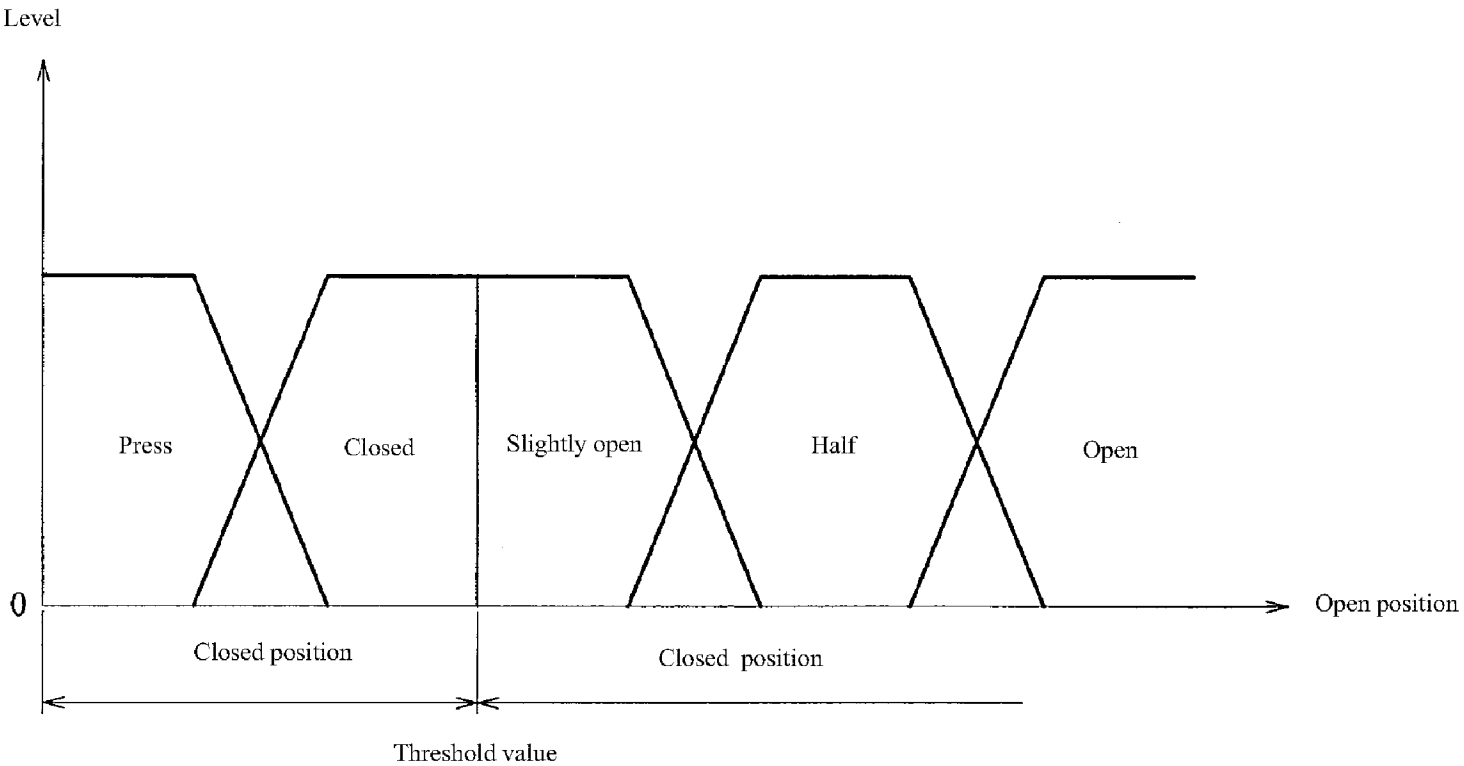
FIG. 7 is a conceptual drawing that shows an example of a relationship between the position of the upper cymbal position and the timbre of the musical tone that is generated by the sound source.
Figures 8A, 8B, 8C:
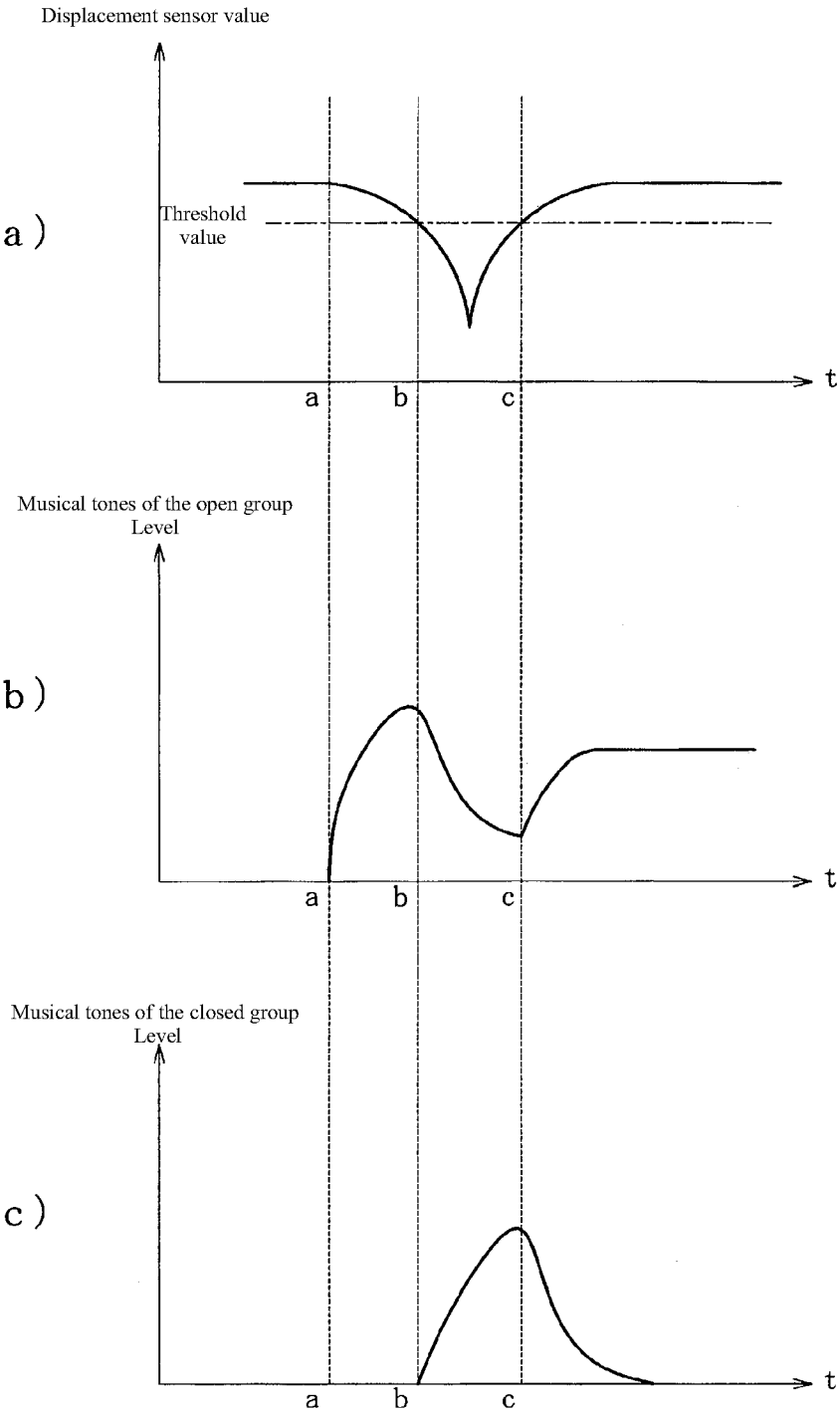
FIGS. 8(*a*)-(*c*) are timing charts that show tone response of prior technology.

If the determination is that the cymbal has been struck (S2: yes), a determination is made as to whether the current upper cymbal position that has been detected by the displacement sensor 60 is an open position or not (S3). In this embodiment, to simplify the explanation, if the upper cymbal position is above a specified position (the open position in FIG. 7), the sound source outputs an open sound (an open, half, or slightly open sound) and if the position is below a specified position (the closed position in FIG. 7), a closed sound (closed or press) is output. Embodiments may be configured such that the sound source outputs an open sound (or, alternatively, a closed sound), if the upper cymbal position is equal to the specified position.

If the determination is that the upper cymbal position is an open position (S3: yes), an instruction is issued to the sound source 7 such that an open sound is generated (S4). A determination is made as to whether or not the vibration level that has been detected by the vibration sensor 70 is greater than a second threshold value (S5). The second threshold value is set to a value that is greater than the first threshold value. If the determination is that the vibration level that has been detected by the vibration sensor 70 is greater than the second threshold value (S5: yes), the striking flag that is stored in the flag memory 4*a* is set (S6) and the timing by the timer 2*a* starts (S7). Embodiments may be configures such that the determination that the vibration level detected by the vibration sensor 70 is equal to the second threshold value, the striking flag may be set to start the timer 2*a* (or, alternatively, not set, so as not to start the timer 2*a*).

On the other hand, if the determination has been made (in S3) that the upper cymbal position is lower than the specified position and is not in the region in which an open sound is output (S3: no), an instruction is issued to the sound source 7 such that a closed sound is generated (S8). If the determination has been made (in S2) that the cymbal has not been struck (S2: no), or if the processing of S7 has completed, or if the processing of S8 has completed, or if in the determination processing of S5, it has not been determined that the vibration level that has been detected by the vibration sensor 70 is greater than the second threshold value (S5: no), the displacement sensor processing is carried out next (S9) and after the displacement sensor processing has completed, the routine returns to the processing of S2.

FIG. 3 is a flowchart that shows an example of displacement sensor processing. In the displacement sensor processing, first, the displacement sensor value that has been input to the input section 6 from the displacement sensor 60 and A/D converted is read out (S11) and, next, a determination is made as to whether or not the vibration flag is set (S12). If the vibration flag is set (S12: yes), a determination is made as to whether or not the timer 2*a* has timed a specified time period T0 (for example, but not limited to, 100 msec) (S13). If the timer 2*a* has timed the specified time period T0 (S13: yes), the vibration flag that is stored in the flag memory 4*a* is reset (S14). The specified time period T0 is set to the maximum period of time for the upper cymbal 100 to be positioned in the closed position due to the striking of the upper cymbal 100 by the performer, which can be determined in accordance with the material, structure, and the like of the upper cymbal 100.

If the vibration flag is not set (S12: no), or if the processing of S14 has completed, a determination is made as to whether or not the upper cymbal 100 has shifted from an open position to the closed position (S15). The upper cymbal position that had been detected the previous time is stored in the upper cymbal position memory 4*b* and the determination as to whether or not the position of the upper cymbal 100 has shifted from the an open position to the closed position is made by means of the position that has been detected in the current time. After the completion of the determination, the upper cymbal position that has been detected the current time is stored in the upper cymbal position memory 4*b*.

If the upper cymbal position has shifted from an open position to the closed position (S15: yes), an instruction is issued to the sound source 7 to stop the open sound (S16). If, in the determination processing of S13, the time period that has been timed by the timer 2*a* has not reached T0 (S13: no), or if, in the determination processing of S15, the upper cymbal position has not shifted from an open position to the closed position (S15: no), or if the processing of S16 has completed, the displacement sensor processing ends and the routine returns to the main processing.

As has been explained above with regard to the first preferred embodiment, until a specified period of time from the detection of a strike to the upper cymbal 100 is reached by the timing of the timer 2*a*, the upper cymbal position is not detected. Accordingly, the instrument may be controlled such that even if the position of the upper cymbal 100 has shifted to the closed position, the musical tone that is generated due to the fact that the upper cymbal 100 has been struck is not stopped. Therefore, even if the performer strikes the upper cymbal 100 and causes the upper cymbal 100 to drop and reach the closed position, an unintended stoppage of the musical tone is not carried out. In one embodiment, if the upper cymbal 100 is struck strongly and the vibration level of the upper cymbal 100 is greater than the second threshold value, the timing by the timer 2*a* is carried out for a specified period of time, during which the stopping of the musical tone is suppressed. On the other hand, if the period of time that is timed by the timer 2*a* has exceeded the specified time period T0, the upper cymbal position is detected and the open sound is stopped, as in the case of a closed position.

A second embodiment is described with reference to FIG. 4. The second embodiment is described with respect to features of the displacement sensor processing that differ from FIG. 3, while other portions of the instrument and processing in the second embodiment may be the same or similar to those described above with regard to the first embodiment. In the second embodiment, in addition to the vibration flag, the position flag is stored in the flag memory 4*a* of the RAM 4. The position flag is set if the upper cymbal position has shifted from an open position to the closed position in the interval until the lapse of the specified time period T1 from the time that the upper cymbal 100 has been struck. The position flag is reset if the specified time period T2 has lapsed from that time.

In the second embodiment, when the upper cymbal 100 has been struck, the timing by the timer 2*a* starts and if the upper cymbal position has shifted from an open position to the closed position in the interval until the lapse of the specified time period T1, the timing by the timer 2*a* is restarted. If after the specified time period T2, the upper cymbal position is in the closed position as before, control is carried out such that the musical tone that is generated is stopped. As a result, if the performer has operated the foot pedal 440 of the electronic hi-hat 80 and shifted the upper cymbal 100 to the closed position during the specified time period T1, it is possible to immediately stop the musical tone.

Figure 4:
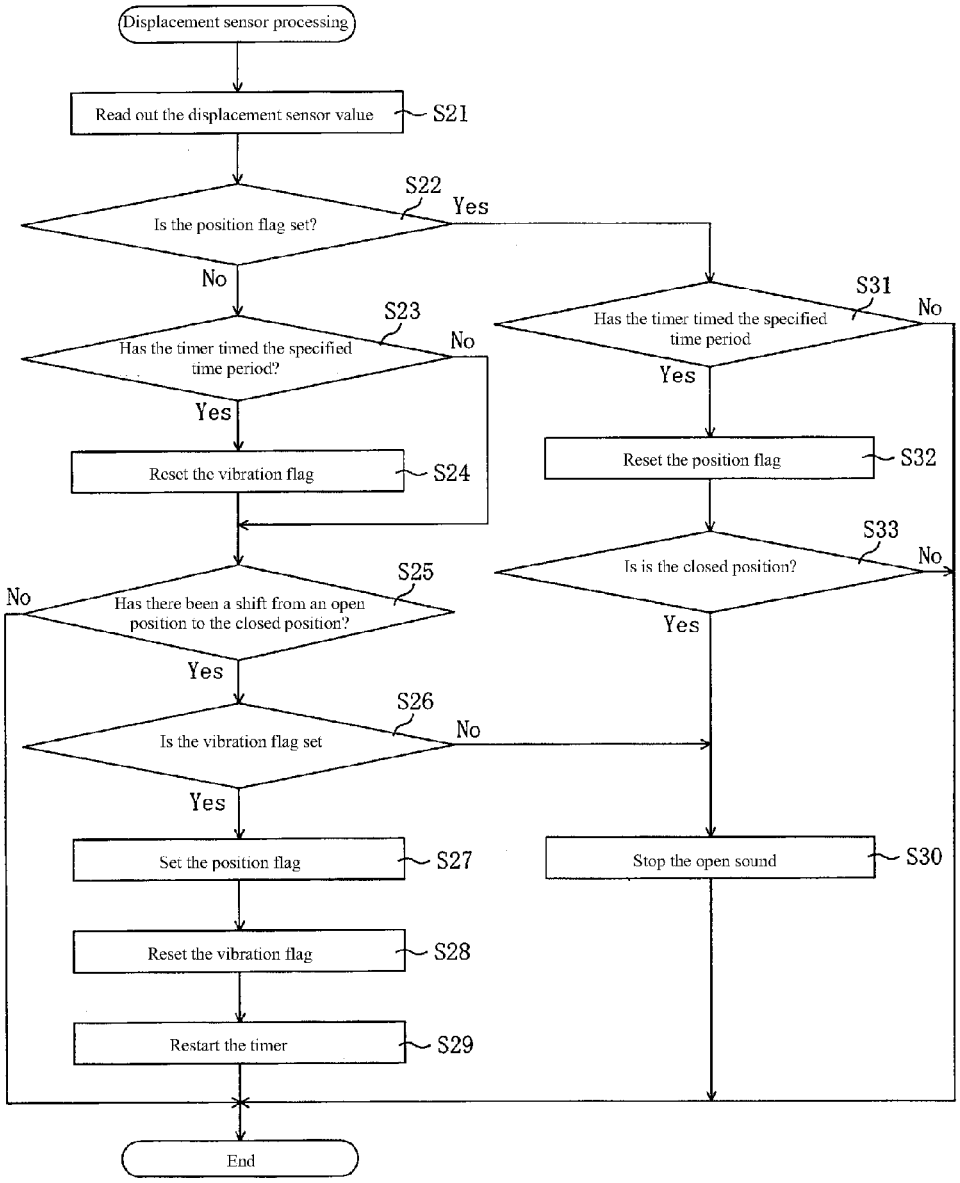
FIG. 4 is a flowchart that shows an example of displacement sensor processing according to a second embodiment of the present invention.

FIG. 4 is a flowchart that shows an example of displacement sensor processing according to the second embodiment. First, the displacement sensor value, which has been input to the input section 6 from the input sensor 60 and A/D converted, is read out (S21). Next, a determination is made as to whether or not the position flag is set (S22). The position flag is, in the same manner as the vibration flag, reset at the time that the power is turned on.

If the position flag is not set (S22: no), a determination is made as to whether or not the specified time period T1 (for example, 100 msec) has been timed by the timer 2*a* (S23). If the timer 2*a* has timed the specified time period T1 (S23: yes), the vibration flag is reset (S24).

If the processing of S24 has completed, or if the timer 2*a* has not timed the specified time period T1 (S23: no), a determination is made as to whether or not the upper cymbal position has shifted from an open position to the closed position (S25). If the upper cymbal position has shifted from an open position to the closed position (S25: yes), a determination is made as to whether or not the vibration flag is set (S26) and if the vibration flag is set (S26: yes), the position flag is set (S27) and, together with this, the vibration flag is reset (S28) and the timer 2*a* starts again (S29) On the other hand, if, in the determination processing of S26, the vibration flag is not set (S26: no), an instruction is issued to the sound source 7 so as to stop the open sound that is being generated (S30). If, in the determination processing of S25, the upper cymbal position has not shifted from an open position to a closed position (S25: no), or if the processing of S28 has completed, or the processing of S30 has completed, the displacement sensor processing ends.

If, in the determination processing of S22, the position flag is set (S22: yes), a determination is made as to whether or not the timer 2*a* has timed the specified time period T2. This specified time period T2 is a period of time that is shorter than the specified time period T1, which has been determined in S13 (for example, 60 msec), and is the shortest period of time for the upper cymbal 100 to be positioned lower than a closed position where the performer has stepped on the foot pedal 440.

If the timer 2*a* has timed the specified period of time T2 (S32: yes), the position flag is reset (S32) and a determination is made as to whether or not the upper cymbal position has been positioned lower than the closed position (S33). If the upper cymbal position is positioned lower than the closed position (S33: yes), an instruction is issued to the sound source 7 so as to stop the open sound that is being generated (S30), since this is a case in which the performer has stepped on the foot pedal 440. If the timer 2*a* has not timed the specified time period T2 (S31: no), or if the upper cymbal position has been positioned above the closed position (S33: no), the displacement sensor processing ends and the routine returns to the main processing.

As has been explained above, in the second embodiment, if a strike on the upper cymbal 100 has been detected, the timing by the timer 2*a* starts. Then, if the upper cymbal 100 has shifted from an open position to the closed position before the lapse of the specified time period T1 by the timer, the timing restarts. If the timing of the specified time period T2 by the timer has lapsed, control is implemented such that when the upper cymbal position is not in the closed position, the stopping of the open sound that is being generated is not carried out. If the specified time period T2 has lapsed, when the upper cymbal position is the closed position, the open sound that is being generated is stopped. Therefore, even in those cases where the performer strikes the upper cymbal 100 to produce an open sound, such that the upper cymbal drops due to the striking and reaches the closed position, the open sound is not stopped. As a result, it is possible for the performer to carry out the control of the musical tone that is intended.

A third embodiment is described with reference to FIG. 5. In the first embodiment discussed above, during the interval that the time period timed by the timer 2*a* is T0, the upper cymbal position is ignored and because of this, even if the upper cymbal 100 is actually in the closed position, the stopping of the open sound that is being generated is suppressed. In the third embodiment, during the interval of a specified period of time T3 that is timed by the timer 2*a*, fluctuations of the upper cymbal position are input to a lowpass filter, changed to dampened fluctuations, and the upper cymbal position is determined based on the changed position information. By carrying out this processing, even if the upper cymbal 100 is struck and the upper cymbal 100 has actually reached the closed position, the fluctuations of the upper cymbal position are dampened and the closed position is not determined to have been reached.

Figure 5:
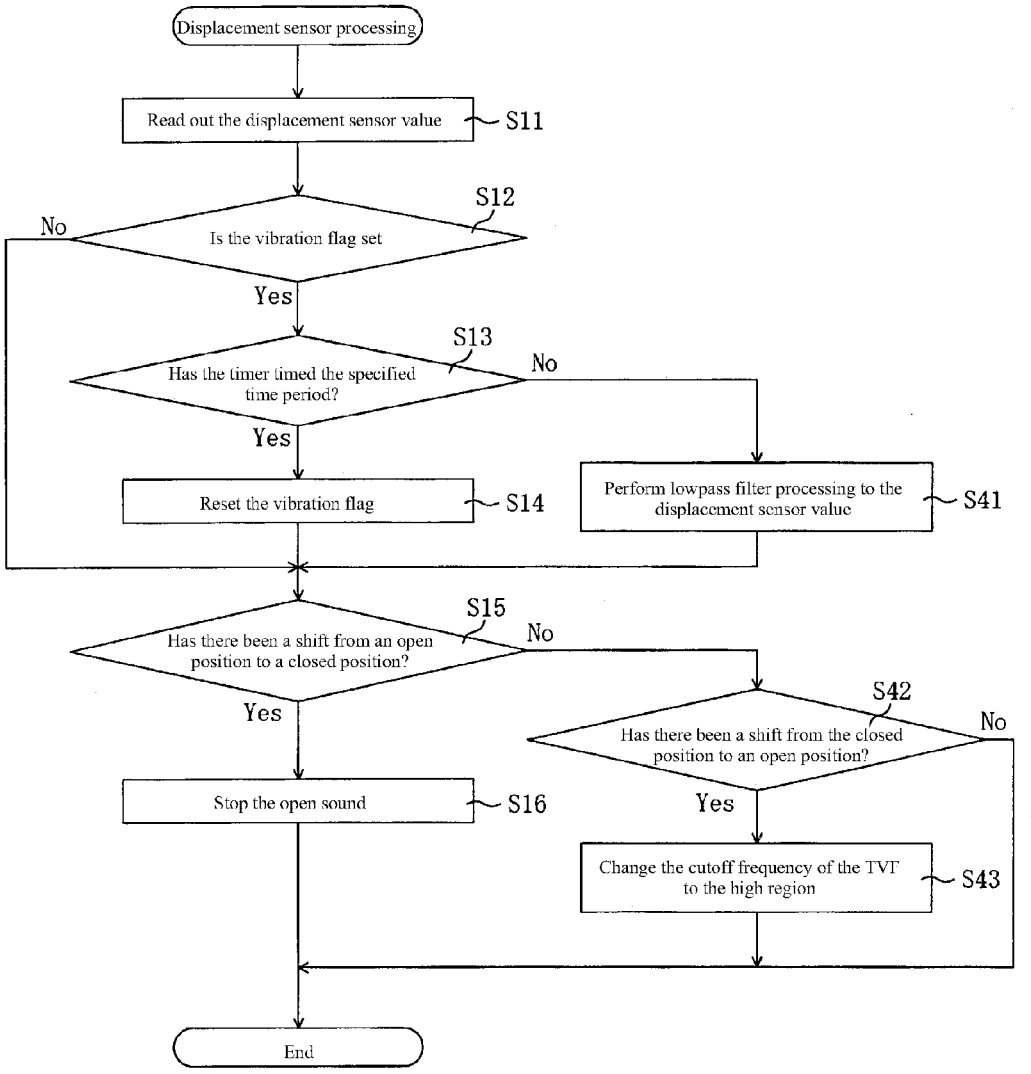
FIG. 5 is a flowchart that shows an example of displacement sensor processing according to a third embodiment of the present invention.

FIG. 5 is a flowchart that shows an example of displacement sensor processing according to the third embodiment. With regard to the steps for the processing that are similar or identical to the displacement sensor processing in the first embodiment discussed above, the same reference keys have been used and detailed explanations are omitted.

In the displacement sensor processing in the third embodiment, if the vibration flag is set (S12: yes), a determination is made as to whether or not the specified time period T3 (for example, 80 msec) has been timed by the timer 2*a* (S13). If the specified time period T3 has been timed by the timer 2*a* (S13: yes), the vibration flag that is stored in the flag memory 4*a* is reset (S14).

If the period of time that has been timed by the timer 2*a* is within the specified time period T3 (S13: no), lowpass filter processing of the value of the upper cymbal position that has been detected in the processing of S11 is performed (S41). The lowpass filter processing includes processing in which the fluctuations in the upper cymbal position are changed into dampened fluctuations. For example, integral processing in which the difference between the upper cymbal position that was detected the previous time (stored in the upper cymbal position memory 4*b*) and the upper cymbal position that has been detected the present time is multiplied by a specified coefficient (a value that is smaller than 1). The product is added to the upper cymbal position that was detected the previous time, and the added value becomes the current upper cymbal position. This changed upper cymbal position is stored in the upper cymbal position memory 4*b*.

If the vibration flag has not been set (S12: no), or if the processing of S14 or the processing of S41 has completed, a determination is made as to whether or not the upper cymbal position has shifted from an open position to the closed position based on the upper cymbal position that has been stored in the upper cymbal position memory 4*b* (S15).

Accordingly, if the period of time that has been timed by the timer 2*a* has not reached the specified time period T3, a determination is made as to whether or not the upper cymbal 100 has shifted from an open position to the closed position using the upper cymbal position that has been lowpass filter processed and changed. Therefore, even if the upper cymbal 100 has been struck by the performer and the upper cymbal 100 has dropped because of the striking, the position of the upper cymbal 100 is changed to a low value and it is possible to suppress the determination being made that the upper cymbal 100 has shifted from an open position to the closed position.

On the other hand, if the specified time period T3 for the period of time timed by the timer 2*a* has lapsed, a determination is made as to whether or not the upper cymbal 100 has shifted from an open position to the closed position using the upper cymbal position that has not been lowpass filter processed. Accordingly, it is possible to immediately stop the musical tone if the performer has operated the foot pedal 44 and shifted the upper cymbal 100 to a closed position.

If the position of the upper cymbal 100 has shifted from an open position to the closed position (S15: yes), an instruction is issued to the sound source 7 to stop the open sound (S16). In addition, if the position of the upper cymbal 100 has not shifted from an open position to the closed position (S15: no), a determination is made as to whether or not the upper cymbal position has shifted from the closed position to an open position based on the upper cymbal position that has been stored in the upper cymbal position memory 4*b* (S42).

If the upper cymbal position has shifted from the closed position to an open position (S42: yes), the cutoff frequency of the TVF that is formed by the sound source 7 is changed to the high region (S43). The cutoff frequency of the TVF is set in the low region if a closed sound is generated.

If the processing of S16 or S43 has completed and, in the determination processing of S42, a determination has been made that the upper cymbal position has not shifted from the closed position to an open position, the displacement sensor processing ends and the routine returns to the main processing.

As explained above regarding the third embodiment, if the upper cymbal 100 has been struck, then during a specified period of time, lowpass filter processing of the upper cymbal position that has been detected is carried out and the fluctuations of the upper cymbal position are dampened. Even in those cases where the upper cymbal 100 has actually dropped to the closed position, a determination is made that upper cymbal position is not the closed position and it is possible to suppress an unintended stopping of the open sound.

While aspects of embodiments of the present invention are described above, the present invention is in no way limited to the specific embodiments discussed above. Various modifications and changes are possible and can easily be understood to be within the scope of the present invention and do not deviate from the purpose of the present invention.

For example, embodiments described above are configured such that, if the vibration level detected by the vibration sensor 70 is greater than a specified threshold value, the timing starts. Then, until a specified time period T0, T1, or T3 has elapsed, the stopping of the musical tone is suppressed. However, the specified time period may also be set in conformance with the upper cymbal position that has been detected by the displacement sensor 60. For example, if the position of the upper cymbal 100 is close to the closed position, the specified time period would be set to be relatively short, but if the position of the upper cymbal 100 is a position that is above and predefined distant from the closed position, the period would be set longer. As a result, it would be possible to carry out the stopping of the sound generation quickly by means of a foot pedal operation if the position of the upper cymbal 100 is close to the closed position. However, when the position of the upper cymbal 100 is above and distant from the closed position, it would be possible to suppress the stopping of the sound generation if the position of the upper cymbal 100 has reached the closed position from an open position after a predefined delay.

In addition, further embodiments may be controlled such that the specified time period is set to a time period in conformance with the vibration level. In other words, control may be carried out such that, if the vibration level is small, the specified time period would be made 0, and if the vibration level is above a specified value, the specified time period would be set in proportion to the vibration level.

In addition, in the first embodiment described above, control is carried out such that if striking of the striking surface 110 of the upper cymbal 100 has been detected, the position of the upper cymbal 100 is not detected during the specified time period T0. However, control may also be carried out such that, during the specified time period T0, a specified value is added to the upper cymbal position that has been detected, or such that only the specified value for the closed position is set low where the upper cymbal 100 does not reach the closed position.

In addition, in the third embodiment described above, control is carried out such that filter processing that dampens the fluctuations of the upper cymbal position is executed by the program. However, control may be carried out such that the position of the upper cymbal 100 is converted into an analog electrical signal and the processing implemented using a commonly known analog lowpass filter, for example, configured by resistors, capacitors, and the like.

What is claimed is:

1. An electronic percussion instrument comprising:

position detection means for detecting a position of a striking surface that is set to any arbitrary position;

striking detection means for detecting whether the striking surface has been struck;

musical tone generation instruction means for instructing a sound source to generate a musical tone in conformance with a position of the striking surface detected by the position detection means, in the event that the striking detection means detects a strike on the striking surface;

musical tone stopping instruction means for instructing the sound source to stop or discontinue generating the musical tone, if the position of the striking surface detected by the position detection means is a first position;

first timing means for timing at least one specified time period from which the striking detection means detects that the striking surface has been struck; and control means for suppressing the instructing of the sound source to stop or discontinue generating the musical tone during a time interval up to the lapse of a first specified time period timed by the first timing means.

2. The electronic percussion instrument in claim 1, wherein the control means further includes means for controlling such that if, after the lapse of the first specified time period, the position that has been detected by the position detection means is the first position, then an instruction is issued by the musical tone stopping instruction means to stop or discontinue the musical tone.

3. The electronic percussion instrument in claim 2 wherein:

the musical tone generation instruction means is configured to issue an instruction to the sound source such that, if the position detection means detects that the striking surface is in a second position, a musical tone having a specified timbre is generated, and the first timing means carries out timing, if the position of the striking surface that has been detected by the position detection means is the second position when the striking detection means detects that the striking surface has been struck.

4. The electronic percussion instrument in claim 1 wherein:

the musical tone generation instruction means is configured to issue an instruction to the sound source such that, if the position detection means detects that the striking surface is in a second position, a musical tone having a specified timbre is generated, and the first timing means carries out timing, if the position of the striking surface that has been detected by the position detection means is the second position when the striking detection means detects that the striking surface has been struck.

5. The electronic percussion instrument in claim 1, further comprising:

a vibration level detection means for detecting the level of vibration of the striking surface;

wherein the striking detection means is configured to detect a strike on the striking surface if the level of the vibration detected by the vibration level detection means is greater than a first threshold value; and wherein the first timing means is configured to carry out timing if the vibration level detection means detects a vibration that is greater than a second threshold value, where the second threshold value is greater than the first threshold value.

6. The electronic percussion instrument in claim 2, further comprising:

a vibration level detection means for detecting the level of vibration of the striking surface;

wherein the striking detection means is configured to detect a strike on the striking surface if the level of the vibration detected by the vibration level detection means is greater than a first threshold value; and wherein the first timing means is configured to carry out timing if the vibration level detection means detects a vibration that is greater than a second threshold value, where the second threshold value is greater than the first threshold value.

7. The electronic percussion instrument in claim 4, further comprising:

a vibration level detection means for detecting the level of vibration of the striking surface;

wherein the striking detection means is configured to detect a strike on the striking surface if the level of the vibration detected by the vibration level detection means is greater than a first threshold value; and wherein the first timing means is configured to carry out timing if the vibration level detection means detects a vibration that is greater than a second threshold value, where the second threshold value is greater than the first threshold value.

8. The electronic percussion instrument in claim 1, further comprising:

second timing means for timing at least one second specified time period that starts if, in the at least one first specified time period timed by the first timing means, the position detection means detects that the striking surface is in the first position, and wherein the control means is configured such that, if a second specified time timed by the second timing means has lapsed and the position detection means detects the position of striking surface as not being the first position, the control means suppresses the instruction to stop or discontinue the musical tone by the musical tone stopping instruction means;

wherein the control means is further configured such that, the instruction to stop or discontinue the musical tone by the musical tone stopping instruction means is carried out if the position of the position detection means detects the striking surface position to be the first position.

9. The electronic percussion instrument in claim 2, further comprising:

second timing means for timing at least one second specified time period that starts if, in the at least one first specified time period timed by the first timing means, the position detection means detects that the striking surface is in the first position, and wherein the control means is configured such that, if a second specified time timed by the second timing means has lapsed and the position detection means detects the position of striking surface as not being the first position, the control means suppresses the instruction to stop or discontinue the musical tone by the musical tone stopping instruction means;

wherein the control means is further configured such that, the instruction to stop or discontinue the musical tone by the musical tone stopping instruction means is carried out if the position of the position detection means detects the striking surface position to be the first position.

10. The electronic percussion instrument in claim 4, further comprising:

second timing means for timing at least one second specified time period that starts if, in the at least one first specified time period timed by the first timing means, the position detection means detects that the striking surface is in the first position, and wherein the control means is configured such that, if a second specified time timed by the second timing means has lapsed and the position detection means detects the position of striking surface as not being the first position, the control means suppresses the instruction to stop or discontinue the musical tone by the musical tone stopping instruction means;

wherein the control means is further configured such that, the instruction to stop or discontinue the musical tone by the musical tone stopping instruction means is carried out if the position of the position detection means detects the striking surface position to be the first position.

11. The electronic percussion instrument in claim 5, further comprising:

second timing means for timing at least one second specified time period that starts if, in the at least one first specified time period timed by the first timing means, the position detection means detects that the striking surface is in the first position, and wherein the control means is configured such that, if a second specified time timed by the second timing means has lapsed and the position detection means detects the position of striking surface as not being the first position, the control means suppresses the instruction to stop or discontinue the musical tone by the musical tone stopping instruction means;

wherein the control means is further configured such that, the instruction to stop or discontinue the musical tone by the musical tone stopping instruction means is carried out if the position of the position detection means detects the striking surface position to be the first position.

12. The electronic percussion instrument in claim 1 further comprising:

filter means for changing the position that have been detected by the position detection means to dampened fluctuations, and wherein the control means is configured such that, if a first specified time period is being timed by the first timing means and has not lapsed, a position that has been changed by the filter means is the first position and the control means instructs the sound source to stop or discontinue the musical tone generated in conformance with an instruction by the musical tone generation instruction means, wherein the control means is further configured such that if, after the lapse of the first specified time period timed by the first timing means, a position that has been detected by the position detection means is the first position and the instruction to stop or discontinue the musical tone by the musical tone stopping instruction means is carried out.

13. The electronic percussion instrument in claim 2 further comprising:

filter means for changing the position that have been detected by the position detection means to dampened fluctuations, and wherein the control means is configured such that, if a first specified time period is being timed by the first timing means and has not lapsed, a position that has been changed by the filter means is the first position and the control means instructs the sound source to stop or discontinue the musical tone generated in conformance with an instruction by the musical tone generation instruction means, wherein the control means is further configured such that if, after the lapse of the first specified time period timed by the first timing means, a position that has been detected by the position detection means is the first position and the instruction to stop or discontinue the musical tone by the musical tone stopping instruction means is carried out.

14. The electronic percussion instrument in claim 4 further comprising:

filter means for changing the position that have been detected by the position detection means to dampened fluctuations, and wherein the control means is configured such that, if a first specified time period is being timed by the first timing means and has not lapsed, a position that has been changed by the filter means is the first position and the control means instructs the sound source to stop or discontinue the musical tone generated in conformance with an instruction by the musical tone generation instruction means, wherein the control means is further configured such that if, after the lapse of the first specified time period timed by the first timing means, a position that has been detected by the position detection means is the first position and the instruction to stop or discontinue the musical tone by the musical tone stopping instruction means is carried out.

15. The electronic percussion instrument in claim 5 further comprising:

filter means for changing the position that have been detected by the position detection means to dampened fluctuations, and wherein the control means is configured such that, if a first specified time period is being timed by the first timing means and has not lapsed, a position that has been changed by the filter means is the first position and the control means instructs the sound source to stop or discontinue the musical tone generated in conformance with an instruction by the musical tone generation instruction means, wherein the control means is further configured such that if, after the lapse of the first specified time period timed by the first timing means, a position that has been detected by the position detection means is the first position and the instruction to stop or discontinue the musical tone by the musical tone stopping instruction means is carried out.

16. An electronic percussion instrument comprising:

a striking surface configured to receive strike impacts;

a position detector configured to detect a relative position of a striking surface;

a strike detector operatively coupled to the striking surface to detect a strike on the striking surface;

a musical tone generator configured to provide signals to a sound source to generate a musical tone at least partially dependent on the relative position of the striking surface as detected by the position detector;

a controller configured to control generation of the musical tone to stop or discontinue the musical tone in the event that the relative position of the striking surface detected by the position detector is a first position, and to suppress the control to stop or discontinue the musical tone prior to the lapse of a first time specified time period timed from a detection of a strike on the striking surface by the strike detector.

17. The electronic percussion instrument in claim 16, wherein the controller is configured such that if, after the lapse of the first specified time period, the position that has been detected by the position detector is the first position, then the controller causes an instruction to be issued to stop or discontinue the musical tone.

18. The electronic percussion instrument in claim 16 wherein:

the musical tone generator is configured to issue signals to the sound source such that, if the position detector detects that the striking surface is in a second position, a musical tone having a specified timbre is generated, and the controller is configured such that the first specified time period is started upon the position of the striking surface that has been detected by the position detector being a second position when the striking detector detects that the striking surface has been struck.

19. The electronic percussion instrument in claim 16, further comprising:

a vibration level detector operatively coupled to detect a level of vibration of the striking surface;

wherein the striking detector is configured to detect a strike on the striking surface if the level of the vibration detected by the vibration level detector is greater than a first threshold value; and wherein the controller is configured such that first specified time period is started if the vibration level detector detects a vibration that is greater than a second threshold value, where the second threshold value is greater than the first threshold value.

20. A method of controlling an electronic percussion instrument comprising:

detecting a position of a striking surface;

detecting a strike on the striking surface;

instructing a sound source to generate a musical tone in conformance with a position of the striking surface, in response to the detection of a strike on the striking surface;

instructing the sound source to stop or discontinue generating the musical tone, if the position of the striking surface is detected to be a first position;

timing at least one first specified time period from a time at which a strike on the striking surface has been detected; and suppressing the instructing of the sound source to stop or discontinue generating the musical tone during a time interval up to the lapse of a first specified time period.

* * * * *